United States Patent [19]

Oberstrass

[11] 4,370,851

[45] Feb. 1, 1983

[54] YARN FALSE TWISTING APPARATUS HAVING ADJUSTABLE FRICTION DISCS

[75] Inventor: Detley Oberstrass, Tönisheide, Fed. Rep. of Germany

[73] Assignee: Barmag Barmer Maschinenfabrik AG, Remscheid, Fed. Rep. of Germany

[21] Appl. No.: 273,077

[22] Filed: Jun. 12, 1981

[30] Foreign Application Priority Data

Jun. 14, 1980 [DE] Fed. Rep. of Germany ..... 3022421
Jul. 9, 1980 [DE] Fed. Rep. of Germany ..... 3025921

[51] Int. Cl.[3] ..... D02G 1/08

[52] U.S. Cl. ..... 57/340; 57/105; 57/339

[58] Field of Search ..... 57/104, 105, 334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,047,374 | 9/1977 | Venot | 57/338 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/348 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes
*Attorney, Agent, or Firm*—Bell, Seltzer, Park & Gibson

[57] ABSTRACT

A yarn false twisting apparatus is disclosed which comprises a pair of cooperating friction discs which define a twisting zone between opposed friction surfaces thereof. One of the discs is composed of a thin flexible material, and a pressure applying member is mounted adjacent the back side of the flexible disc for biasing the disc toward the other disc locally at the twisting zone to firmly engage the yarn passing therethrough. The discs are laterally movable with respect to each other, and the pressure applying member is movable in a direction perpendicular to the movement of the discs, such that the ratio of twist insertion to yarn speed may be varied. In one illustrated embodiment, the discs and pressure applying member are interconnected for effecting synchronized relative movement, and these components are mounted on a support bracket which is pivotal through 180 degrees to thereby permit selective operation in a first position wherein S twist is imparted to the yarn and a second position wherein Z twist is imparted.

23 Claims, 8 Drawing Figures

YARN FALSE TWISTING APPARATUS HAVING ADJUSTABLE FRICTION DISCS

The present invention relates to an improved yarn false twisting apparatus, of the type disclosed in commonly owned copending application Ser. No. 168,734, filed July 14, 1980 and now U.S. Pat. No. 4,339,915.

In copending application No. 168,734, there is disclosed an apparatus for false twisting a yarn which comprises a thin flexible or pliable disc mounted for rotation with a cooperating disc or roller to define a twisting zone between opposing friction surfaces thereof. A pressure applying member is mounted adjacent the back face of the pliable disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone.

It is an object of the present invention to further develop the friction false twisting apparatus according to the prior patent application such that the ratio of twist to yarn conveyance speed may be selectively varied, without any significant operative effort.

It is also an object of the present invention to provide a false twisting apparatus of the described type which is characterized by the ability to readily change from S to Z twist and vice versa.

These and other objects and advantages of the present invention are achieved in the embodiments illustrated herein by the provision of a false twisting apparatus which includes a pair of twist imparting circular discs and which are mounted in opposing relationship and define a twisting zone therebetween. At least one of the discs is relatively thin and flexible, and at least one and preferably both of the discs are mounted for movement along a path of travel which extends in a direction generally perpendicular to their axes of rotation. A pressure applying member is mounted to locally bias the flexible disc toward the other disc at the twisting zone, and is movable along a path of travel which is perpendicular to the plane defined by the axes of rotation. By this arrangement, it is readily possible to change the ratio of twist insertion to yarn speed, and in doing so, the twist is imparted independently of the twist insertion-speed ratio on essentially the same disc circumference and therefore at essentially constant circumferential speed of the disc.

In one preferred embodiment, the bearing housings of discs are operatively interconnected with the pressure applying member, such that a synchronized relative movement is automatically effected, and such that the pressure applying member is always the same distance from each of the axes of rotation of the two discs.

It is also preferred that there be a fixed connection between the yarn guides, and particularly the yarn intake guide, and the pressure applying member. Such fixed connection provides for a constant distance between the guides and the twisting zone, which is important in achieving uniform twisting and crimping.

It will also be understood that the invention is essentially independent of the yarn threadline. Thus the yarn may travel parallel to the plane defined by the axes of rotation of the discs, or perpendicular to such plane.

Some of the objects and advantages of the invention having been stated, others will appear as the description proceeds, when taken in connection with the accompanying drawings, in which FIG. 1*a* is a side elevation view of a friction false twisting apparatus embodying the present invention, and wherein the yarn path extends in a direction perpendicular to the plane which is common to the axes of rotation of the two discs;

FIG. 1*b* is a side elevation view of a second embodiment of a friction false twisting apparatus embodying the present invention, and wherein the yarn path extends parallel to the plane which is common to the axes of rotation of the two discs;

Figure 4A:
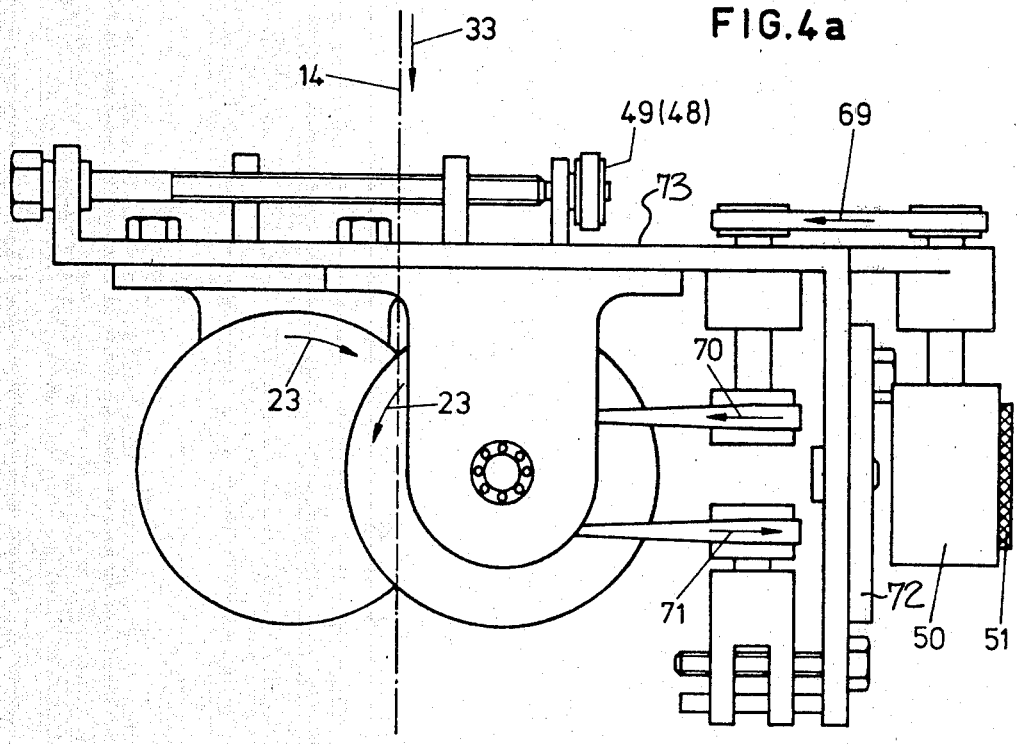
Figure 6:
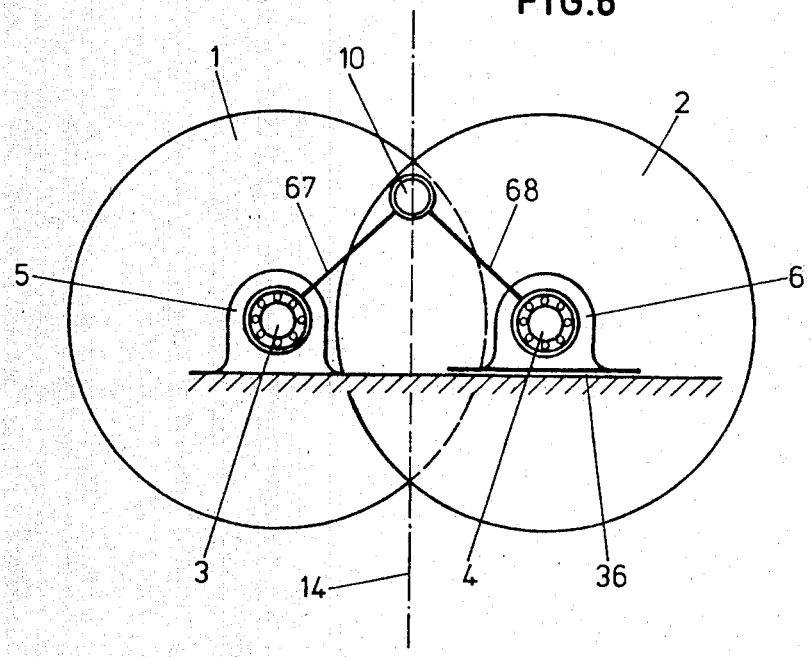
Figure 4B:
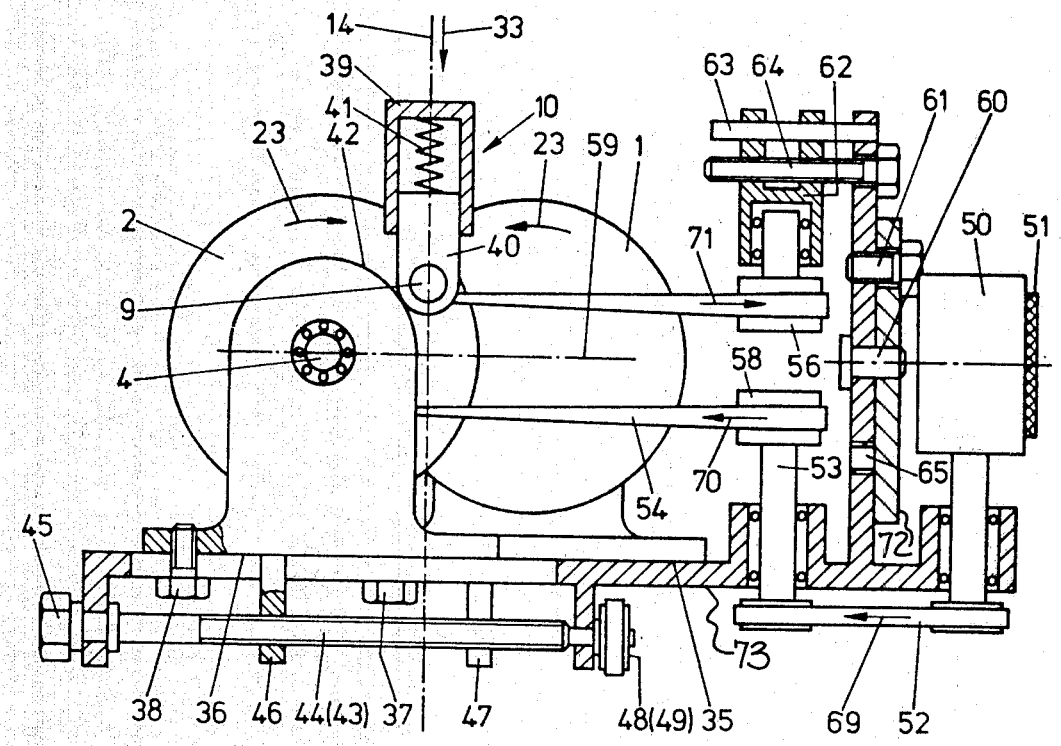
Figure 5:
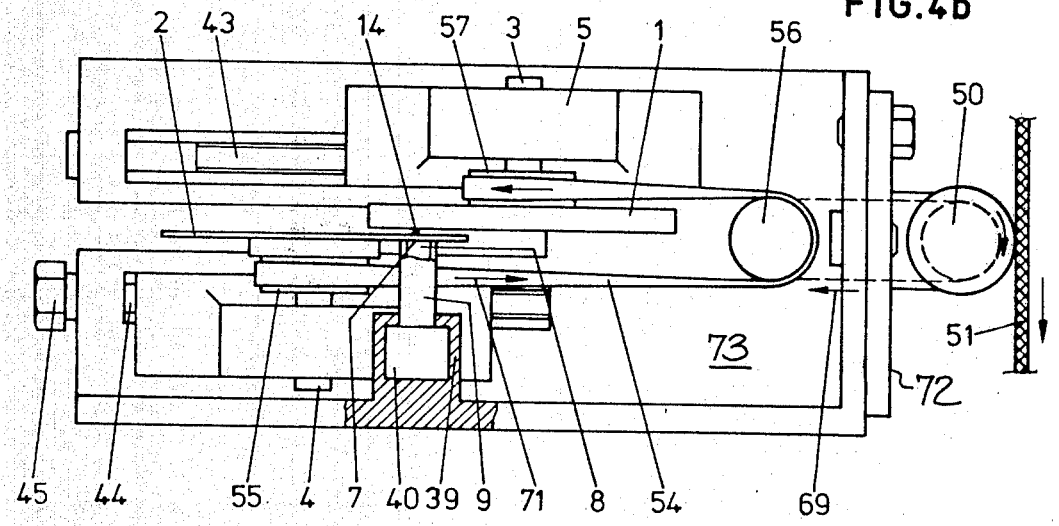

FIG. 4*a* is a side elevation view of a further embodiment of a false twisting apparatus embodying the present invention, and which has the capability of easily switching from S twist insertion to Z twist insertion, and vice versa;

FIG. 4*b* is a partly sectioned side elevation view of the apparatus shown in FIG. 4*a*, and with the apparatus being oriented to impart S twist;

FIG. 5 is a top plan view, partly sectioned, of the apparatus shown in FIG. 4*b*; and FIG. 6 is a schematic view of still another embodiment of the present invention.

Figure 1A:
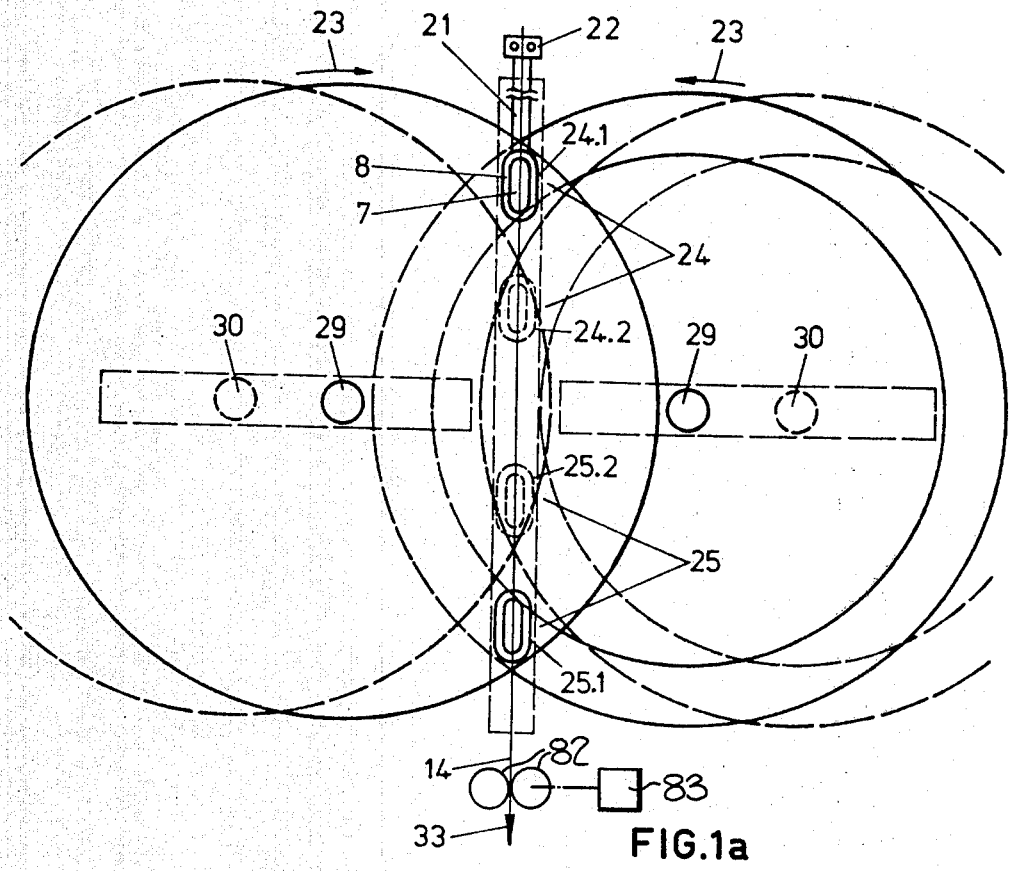
Figure 3:
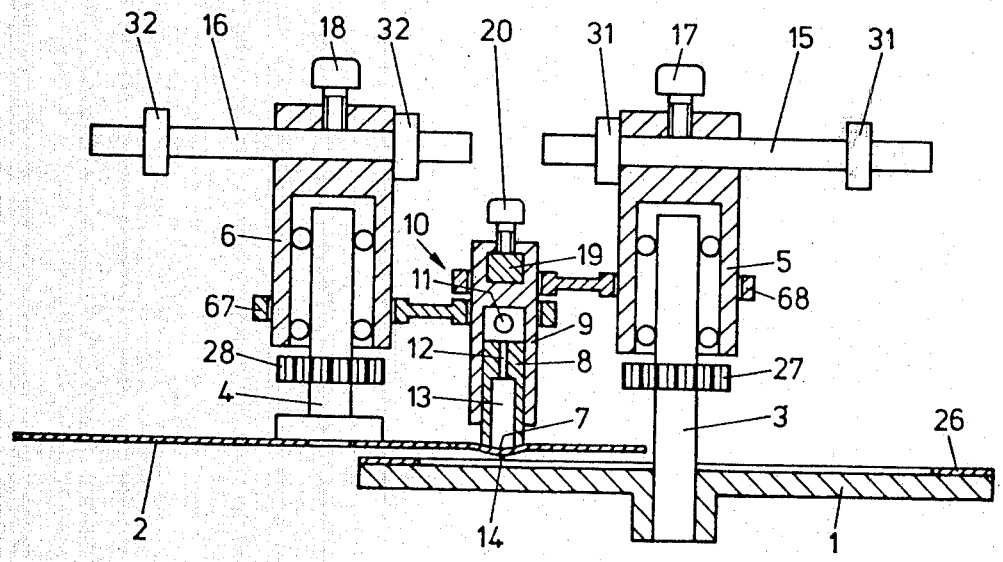
FIG. 3 is a sectioned top plan view of the false twisting apparatus shown in FIG. 1*a;*
Figure 1B:
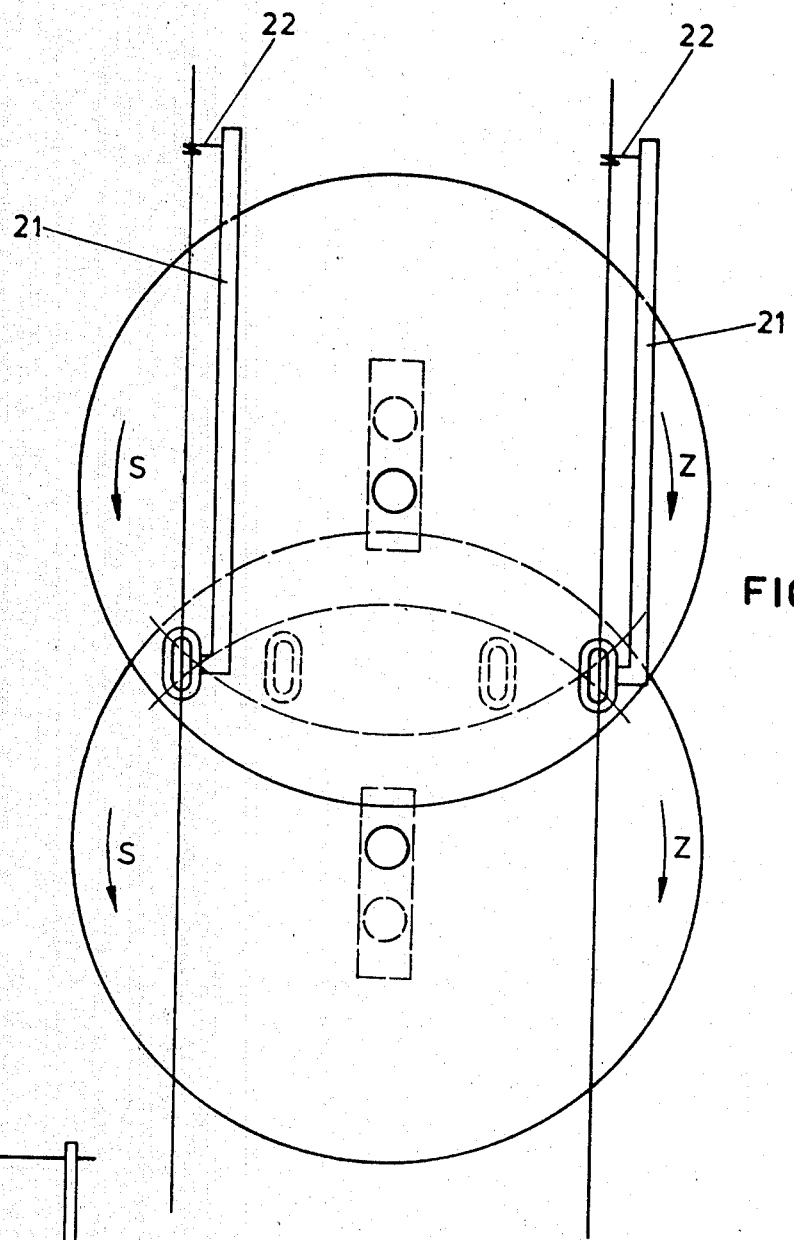

The friction false twist apparatus illustrated in FIGS. 1*a*, 1*b* and 3 consists of a rigid disc 1 and a flexible disc 2. Both discs are rotatably supported on the shafts 3 and 4 in bearing housings 5 and 6. The discs are driven by drives not shown in these figures, through pulleys 27 and 28. The rigid disc is provided with a friction coating 26 which can be rubber, Vulkollan, a wear resistant metal, a plasma coating, a ceramic coating, a nickel-diamond coating, and the like.

The flexible disc 2 consists of a material, or a compound material, which absorbs the tensile forces caused by centrifugal forces, which at the same time, however, can easily be laterally deflected or upset. The disc can be, for example, a rubber disc having a thickness of 0.5 to 2 mm, which has a reinforcing cord thread embedded therein, or a spring steel disc having a thickness of less than 1 mm and an annular friction coating.

The pressure applying member 10 acts upon the back face of the flexible disc 2 by the pressure surface 7 so that the flexible disc is upset in a direction toward the yarn 14. Thus, the yarn is clamped within a narrow zone between the flexible disc 2 and the annular friction surface 26 of the rigid disc 1. The pressure applying member consists of a cylinder 9 and a piston 8 moving therein, which piston has a hollow cavity 13 on its pressure surface 7 facing the flexible discs 2. A pressurized air connection 11 is provided through which the piston is pressed toward the flexible disc, and in addition, pressurized air is forced into the hollow cavity 13. By this arrangement, a pneumatic lubrication and pressurized air cushion is provided between the pressure surface 7 and the flexible disc. Further details concerning the pressure applying member 10 may be obtained from the above referenced copending application.

While the illustrated embodiment utilizes one flexible disc and one rigid disc, it will be understood that both discs could be flexible, and that two aligned pressure applying members could be used, with each such member acting upon the rear surface of one of the flexible discs.

In FIG. 1*a*, the yarn 14 is fed to the friction false twist apparatus via thread-admitting guide 22 in a direction perpendicular to the plane which is common to the two axes of rotation of the discs 1 and 2. Means for adjusting the running speed of the yarn is illustrated schematically in FIG. 1*a* by the rollers 82 and adjustable motor 83.

In FIG. 1*b* the yarn runs through the thread-admitting guide 22 in a direction parallel to the plane which is common to the two axes.

In accordance with the embodiment of the invention illustrated in FIGS. 1*a* and 3, the bearing housings 5 and 6 and the pressure applying member 10 are each displaceable. For displacement, the housings 5 and 6 are provided with guide openings, by means of which they can be moved on the parallel slide rods 15 and 16. The housings are secured by the screws 17 and 18. Thus, the discs are movable between the inner extreme positions 29 and the outer extreme positions 30 shown in FIG. 1*a*. The displacement path extends between the stops 31 on rod 15 and stops 32 on rod 16. The mountings are positioned such that the two shafts or axes have the same distance from the thread line. Likewise, the pressure applying member 10 can be moved on the rectangular rod 19 and held by screw 20. Such movement can be effected between the extreme positions 24.1 and 25.1.

In FIG. 1*a*, the positions 24.1 and 25.1 of the pressure applying member correspond to the position 29 of the discs, and the positions 24.2 and 25.2 correspond to the position 30 of the discs. The discs 1 and 2 rotate in opposite directions 23, and the advancing yarn 14 has a Z twist imparted thereto, with the pressure applying member in the positions 24. An S twist is imparted when the pressure applying member is in the positions 25. The discs are displaced and the member 10 moved between the extreme positions 24.1 and 24.2, if the ratio of twist and yarn advance is to be changed while imparting a Z twist to the yarn. The discs are displaced and the member 10 moved between the positions 25.1 and 25.2, if the ratio of twist and yarn advance is to be changed while imparting an S twist to the yarn.

From the above description, it will be seen that the apparatus illustrated in FIG. 1*a* may be readily converted from S to Z twist, or vice versa, by selective placement of the pressure applying member between a first position on one side of the plane defined by the axes of rotation of the discs, and a second position on the other side of such plane. The direction of rotation remains unchanged, and the yarn path of travel remains unchanged. The position of the discs may also remain unchanged.

It should be understood that between the illustrated extreme positions 29, 30 of the discs, and 24.1 to 24.2 of the pressure applying member 10 for insertion of a Z twist, and 25.1 to 25.2 of the member 10 for insertion of an S twist, any intermediate operational position that is advantageous for the desired false twist method may be selected.

Figure 2:
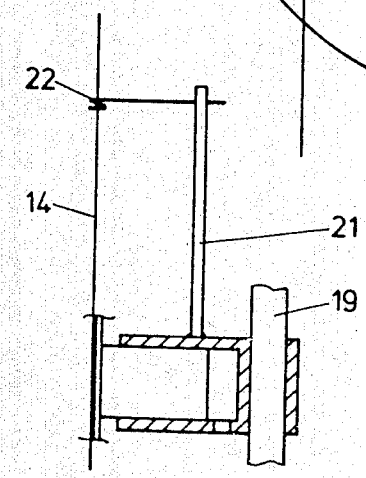
FIG. 2 is a fragmentary side elevation view of the pressure applying member and associated thread guide as may be utilized with the present invention.

It has been found that the insertion of the twist by the friction false twist apparatus is a function of the distance of the thread guides, and particularly of the thread-admitting guide, from the twisting zone, i.e. the point at which the yarn receives the twist. The twisting zone of the friction false twist apparatus of the present invention is defined by the position of the pressure applying member. In order to ensure a constant distance, the thread-admitting guide 22 and the pressure applying member are mechanically connected by a rod 21. This is illustrated in FIG. 2 which shows a friction false twist apparatus with the yarn path of FIG. 1*a*. It should be noted that the length of the rod 21 is determined so that the thread-admitting guide 22 does not come into contact with the discs, even with the pressure applying member in the extreme position 25.1. With the yarn path extending in the direction as shown in FIG. 1*b*, the thread-admitting guide 22 is moved to the other side of the plane which is common to both axes of rotation of the discs, if the apparatus is to switch from S twist to Z twist. With the yarn path as shown in FIG. 1*b*, a change of the rotational direction of the discs is necessary to switch from S to Z twist. This rotational direction of the discs is shown by arrows S and Z. Thus in the case of the embodiment of FIG. 1*b*, conversion from S to Z twist, or vice versa, requires movement of both the yarn path of travel and the pressure applying member from one side of the plane defined by the axes of rotation, to the other side of such plane. Also, the direction of rotation of the discs is reversed. The position of the discs, however, may remain unchanged.

As can be seen from FIG. 3, a synchronization of the displacements may be provided for the bearing housings 5 and 6, and the pressure applying member 10. For this purpose, each housing 5 and 6 is pivotally connected with the pressure applying member 10 by levers 68 and 67, respectively. By moving one movable part (i.e., housing or pressure applying member) the other movable parts are thereby also displaced and properly positioned.

In the embodiment of the friction false twist apparatus according to FIGS. 4*a*, 4*b* and 5, there is provided a rigid disc 1 and a flexible disc 2 which are mounted on shafts 3 and 4 in housings 5 and 6, respectively. Upon movement of its piston 8 in cylinder 9, the pressure applying member 10 acts upon the back face of the flexible disc 2 with the pressure surface 7. A pressurized air connection (not shown here) is also provided in this embodiment, and the yarn 14 runs in a direction perpendicular to the plane 59 defined by the two rotational axes of the discs. In this regard, it will be understood that the rotational axes of the two discs may be somewhat inclined toward each other, and so that the discs have the shortest distance from each other within the region of the pressure surface 7. Thus the plane 59 may not be precisely defined by the two axes of rotation.

The housings 5 and 6 of the two discs are movably mounted on the support bracket 73, and can be adjusted on guides 35 and 36 and locked by locking screws 37 and 38. For adjustment, adjusting screws 43 and 44 are provided which are drivingly connected with each other by a belt and toothed pulleys 48 and 49, and which may be rotated in either direction at the head 45 by means of a wrench. The threaded sleeves 46, 47 are fixedly connected with the housings 6 and 5, and are threadedly engaged by the screws 44, 43 respectively. The threads of the screws are designed such that during the synchronized rotation of the adjusting screws 43, 44 the housings 5 and 6 move in opposite directions.

During the opposed movement of the housings, the pressure applying member 10 slides on the arcuate cam surface 42 of the housing 6 of the shaft 4, with the cam surface being concentric with respect to the shaft 4. The member 10 includes a follower 40 slidably mounted in a receptacle 39 on the support bracket 73, and which is pressed against the surface 42 by spring 41. Thus, depending upon the distance between the axes of the discs, the pressure applying member 10 together with the elements 7, 8, 9 that are important with regard to its function, automatically take a position which is determined by the shape of the cam surface 42.

By the displacement of the two housings 5 and 6, and the discs 1 and 2 along the guides as described above, the ratio of twisting effect and yarn and advance produced by the friction false twist apparatus on the yarn is changed. With the friction false twist apparatus positioned as shown in FIG. 4*b*, and with the direction of travel 33 of the yarn and the rotational direction 23 of the discs, the yarn receives an S twist.

The support bracket 73 is pivotally mounted to the central frame 72 of the apparatus about the axis of pin 60, which axis substantially lies in the plane defined by the axes of rotation of the discs and extends parallel to and between the friction surfaces of the discs. For changing the twisting direction, the bracket 73 is pivoted about the pin 60 by 180 degrees, and secured by means of the holes 65 in the support bracket 73 and screw 61. This opposite position of the friction false twist apparatus, where the yarn receives a Z twist, is shown in FIG. 4*a*.

The following description of the drive serves to explain the change from S to Z twist. The friction false twist apparatus is driven by tangential belt 51 through whorl 50, the whorl being supported in the support bracket 73 of the friction false twist apparatus. The drive whorl 50 is mounted to the support bracket 73 for rotation about an axis disposed perpendicular to the plane defined by the axes of rotation of the discs, and such plane and the axis of pin 60 generally bisect the whorl, note FIG. 4*b*. The rotation is transmitted by transmission belt 52 to the intermediate shaft 53 having a pulley 58. An endless belt 54 extends between pulley 58, disc pulley 55 for the flexible disc, reversing pulley 56, and disc pulley 57 for the rigid disc. The reversing pulley 56 is supported in a ball bearing 62, which can be displaced on guide 63 by screw 64 and positioned for tensioning the belt. When changing form S to Z twist, and vice versa, the direction of run of the tangential belt 51 is not changed, which is advantageous since crimped yarns with an S twist and a Z twist are often produced at the same time on one texturing apparatus. In FIGS. 4*a* and 4*b*, the direction of run of the tangential belt 51 is such that the belt 51 comes out of the plane of the paper, hence the illustrated directions of movement of the belts 52 and 54, and the directions of rotation 23 of the discs. Thus conversion from S to Z twist or vice versa results in the changing of the direction of rotation of the discs, without changing the yarn path of travel.

The schematic view of the embodiment as per FIG. 6 shows the discs 1 and 2 with housings 5 and 6 and pressure applying member 10. Housing 5 is fixedly positioned to the frame of the friction false twist apparatus, whereas mounting 6 is displaceable and fixable on guide 36. For the design of the guide, reference may be made to the above embodiments. The pressure applying member 10 is rigidly connected with housing 5 by lever arm 67, and with mounting 6 by lever arm 68. Both lever arms are pivoted to both the pressure applying member and to the associated housing 5 or 6. Thus, by displacing and positioning housing 6, the pressure applying member 10 automatically takes the determined position. For pivoting the lever arms 67 and 68, any suitable pivotal mounting to the housing, or the shafts 3 or 4, can be employed. Further, the lever arms may be designed to be adjustable in length if desired.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a frame, a pair of twist imparting circular discs, with each disc including a yarn engaging friction surface, and with at least one of said discs being relatively thin and flexible, means mounting said discs to said frame, with said discs being rotatable about generally parallel spaced apart axes and such that portions of the respective yarn engaging friction surfaces are disposed in opposing, face to face relationship and define a twisting zone therebetween, and including means permitting selective relative movement of said discs along a direction generally perpendicular to their axes of rotation and parallel to the plane defined by such axes of rotation, a pressure applying member, means mounting said pressure applying member to said frame for selective movement along a path of travel which extends perpendicular to said plane defined by the axes of rotation of said discs, and so as to locally bias said one flexible disc toward the other disc only at said twisting zone, drive means for rotating each of said discs about their respective axes, and such that a yarn may be continuously advanced through said twisting zone while having twist imparted thereto by frictional contact between the yarn and the respective opposed friction surfaces resulting from the force exerted by the biasing means, whereby the ratio of twist to yarn speed may be selectively varied by selective movement of said discs with respect to said pressure applying member.

2. The yarn false twisting apparatus as defined in claim 1 further comprising a yarn guide fixedly mounted to said pressure applying member so as to maintain its relative position with respect to said pressure applying member during selective movement thereof.

3. The yarn false twisting apparatus as defined in claim 2 wherein said yarn guide defines a yarn path of travel parallel to said path of travel of said pressure applying member.

4. The yarn false twisting apparatus as defined in claim 2 wherein said yarn guide defines a yarn path of travel perpendicular to said path of travel of said pressure applying member and parallel to said plane defined by the axes of rotation of said discs.

5. The yarn false twisting apparatus as defined in claim 1 wherein said means permitting selective relative movement of said discs includes a shaft mounted to each disc and extending along the axis of rotation thereof, a pair of housings each rotatably receiving one of said shafts, and means mounting at least one of said housings for movement along said direction of relative movement.

6. The yarn false twisting apparatus as defined in claim 5 wherein said means mounting at least one of said housings comprises a pair of rods fixedly mounted to said frame, with each rod slidably mounting respective ones of said housings, and with each rod being aligned with said direction of relative movement, and such that both of said discs are movable along said direction.

7. The yarn false twisting apparatus as defined in claim 5 wherein said means permitting relative movement of said discs includes means fixedly mounting one of said housings to said frame, and such that only the other housing is movable along said direction of movement.

8. The yarn false twisting apparatus as defined in claim 5 wherein said means mounting said pressure applying member to said frame includes means for guiding the same along an arc which is concentric to the axis of rotation of said flexible disc.

9. The yarn false twisting apparatus as defined in claim 8 wherein said means for guiding said pressure applying member includes an arcuate cam surface fixed to one of said housings, and a follower fixed to said pressure applying member.

10. The yarn false twisting apparatus as defined in claim 8 wherein said means mounting said pressure applying member to said frame includes a pair of lever arms, with each lever arm being pivotally connected to said pressure applying member and respective ones of said shaft housings.

11. A yarn false twisting apparatus comprising a support bracket, a pair of twist imparting circular discs, with each disc including a yarn engaging friction surface, and with at least one of said discs being relatively thin and flexible, means mounting said discs to said support bracket, with said discs being rotatable about parallel spaced apart axes and such that portions of the respective yarn engaging friction surfaces are disposed in opposing, face to face relationship and define a twisting tibe therebetween, and including means permitting selective movement of each of said discs along a path of travel which extends in a direction generally perpendicular to their axes of rotation and parallel to the plane defined by such axes of rotation, a pressure applying member, means mounting said pressure applying member to said support bracket for selective movement along a path of travel which extends perpendicular to said plane defined by the axes of rotation of said discs, and so as to locally bias said one flexible disc toward the other disc only at said twisting zone, drive means for rotating each of said discs about their respective axes, and such that a yarn may be continuously advanced through said twisting zone in a direction perpendicular to the plane which includes both axes of rotation of said discs, while having twist imparted thereto by frictional contact between the yarn and the respective opposed friction surfaces resulting from the force exerted by the biasing means, means mounted on said support bracket and operatively interconnecting said discs and said pressure applying member for effecting synchronized relative movement thereof along their respective paths of travel, and such that the pressure applying member is always the same distance from each of said axes of rotation, whereby the ratio of twist to yarn speed may be selectively varied by selective movement of said discs with respect to each other and said pressure applying member.

12. The yarn false twisting apparatus as defined in claim 11 wherein said means operatively interconnecting said discs and said pressure applying member includes a pair of threaded parallel spindles rotatably mounted to said support bracket with each of said spindles being threadedly connected to respective ones of said discs, and with said spindles having opposite thread pitch, and means drivingly interconnecting said spindles such that they impart opposite movement to said discs.

13. The yarn false twisting apparatus as defined in claim 11 wherein said drive means includes a drive whorl mounted to said support bracket for rotation about an axis disposed perpendicular to said plane defined by said axes of rotation, with such plane generally bisecting said whorl, and drive belt means operatively interconnecting said drive whorl and said discs.

14. The yarn false twisting apparatus as defined in claim 13 wherein said apparatus further comprises a central frame, said drive means further includes a main drive belt mounted on said central frame for tangentially contacting said whorl, and further comprising means mounting said support bracket to said central frame for selective pivotal movement about an axis which is perpendicular to said axis of rotation of said drive whorl and parallel to said plane defined by said axes of rotation of said discs, and between a first position wherein S twist is imparted to the yarn and a second position disposed 180 degrees from the first position and wherein Z twist is imparted to the yarn.

15. A yarn false twisting apparatus characterized by the ability to readily convert from S to Z twist and vice versa, and comprising a pair of twist imparting circular discs, with each disc including a yarn engaging friction surface, and with at least one of said discs being relatively thin and flexible, means mounting said discs with said discs being rotatable about generally parallel spaced apart axes and such that portions of the respective yarn engaging friction surfaces are disposed in opposing, face to face relationship and define a twisting zone therebetween, a pressure applying member, means mounting said pressure applying member for selective placement in a first position on one side of a plane defined by the axes of rotation of said discs, and a second position on the other side of said plane, and so as to locally bias said one flexible disc toward the other disc and define a twisting zone in each of said positions, drive means for rotating each of said discs about their respective axes, and such that a yarn may be continuously advanced through said twisting zone while having twist imparted thereto by frictional contact between the yarn and the respective opposed friction surfaces resulting from the force exerted by said pressure applying member, and whereby the apparatus may selectively impart S or Z twist by the selective placement of said pressure applying member in either said first or second positions.

16. The yarn false twisting apparatus as defined in claim 15 wherein said means mounting said pressure applying member includes means permitting selective movement along a path of travel which extends generally perpendicular to said plane defined by the axes of rotation of said discs, and whereby the ratio of twist to yarn speed may be selectively varied by selective movement of said pressure applying member.

17. The yarn false twisting apparatus as defined in claim 15 or 16 wherein said means mounting said discs includes means permitting selective relative movement along a direction generally perpendicular to their axes of rotation and parallel to said plane defined by the axes of rotation, and whereby the ratio of twist to yarn speed may be selectively varied by selective movement of said discs with respect to said pressure applying member.

18. The yarn false twisting apparatus as defined in claim 15 wherein said drive means rotates the discs in opposite directions, and wherein the yarn is adapted to be advanced through the twisting zone in a direction perpendicular to said plane defined by said axes of rotation of said discs, and conversion from S to Z twist and vice versa may be accomplished by selective placement of said pressure applying member between said first and second positions, and without changing the direction of rotation of the discs or the yarn path of travel.

19. The yarn false twisting apparatus as defined in claim 15 wherein said drive means rotates the discs in the same rotational direction and includes means for reversing the direction of rotation of both discs, and wherein the yarn is adapted to be advanced through the twisting zone in a direction parallel to said plane defined by said axes of rotation of said discs in each of said positions of said pressure applying member, and whereby conversion from S to Z twist and vice versa may be accomplished by selective placement of said pressure applying member between said first and second positions, positioning the yarn path of travel to extend through the operative twisting zone, and changing the direction of rotation of the discs.

20. A yarn false twisting apparatus characterized by the ability to readily convert from S to Z twist or vice versa, and comprising a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, a pressure applying member, with said pressure applying member being positioned to locally bias said one flexible disc toward the other disc locally at said twisting zone, drive means for rotating each of said discs in opposite directions about their respective axes, and such that a yarn may be advanced along a path of travel through said twisting zone in a direction perpendicular to said plane defined by the axes of rotation of said discs so as to have twist imparted thereto by frictional contact between the yarn and the respective opposed friction surfaces resulting from the force exerted by said pressure applying member, means mounting said discs and pressure applying member to permit pivotal movement through 180 degrees about an axis which substantially lies in the plane defined by the axis of rotation of said discs and extends parallel to and between the friction surfaces of said discs to thereby permit conversion from S to Z twist or vice versa, by changing the direction of rotation of the discs and without changing the yarn path of travel.

21. A method of false twisting a yarn and converting from S to Z twist or vice versa and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship, providing a pressure applying member, with said pressure applying member being positioned in a first position on one side of a plane defined by the axes of rotation of said discs and so as to locally bias said one flexible disc toward the other disc and define a first twisting zone, rotating each of said discs in opposite directions about their respective axes, while advancing a yarn along a path of travel through said first twisting zone in a direction perpendicular to said plane defined by the axes of rotation of said discs so as to have twist imparted thereto by frictional contact between the yarn and the respective opposed friction surfaces resulting from the force exerted by said pressure applying member, and then repositioning said pressure applying member in a second position on the other side of said plane defined by the axes of rotation of said discs and so as to locally bias said one flexible disc toward the other disc and define a second twisting zone, and with the second twisting zone being aligned with said yarn path of travel so that the yarn passes through the second twisting zone, to thereby convert from S to Z twist or vice versa without changing the direction of rotation of the discs or the yarn path of travel.

22. A method of false twisting a yarn and converting from S to Z twist or vice versa, and comprising the steps of providing a pair of twist imparting circular discs, with each disc including a yarn engaging friction surface, and with at least one of said discs being rotatable about parallel spaced apart axes and such that portions of the respective yarn engaging friction surfaces are disposed in opposing, face to face relationship, providing a pressure applying member, with said pressure applying member being positioned in a first position on one side of a plane defined by the axes of rotation of said discs and so as to locally bias said one flexible disc toward the other disc and define a first twisting zone, rotating each of said discs in a common direction about their respective axes, while advancing a yarn along a path of travel through said first twisting zone in a direction parallel to said plane defined by the axes of rotation of said discs so as to have twist imparted thereto by frictional contact between the yarn and the respective opposed friction surfaces resulting from the force exerted by said pressure applying member, and then repositioning said pressure applying member in a second position on the other side of said plane defined by the axes of rotation of said discs and so as to locally bias said one flexible disc toward the other disc and define a second twisting zone, and repositioning the yarn path of travel to pass through said second twisting zone in a direction parallel to said plane defined by the axes of rotation of said discs, and reversing the direction of rotation of each disc, to thereby convert from S to Z twist or vice versa.

23. A method of false twisting a yarn and converting from S to Z twist or vice versa, and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, providing a pressure applying member, with said pressure applying member being positioned to locally bias said one flexible disc toward the other disc locally at said twisting zone, rotating each of said discs in opposite directions about their respective axes, while advancing a yarn along a path of travel through said twisting zone in a direction perpendicular to said plane defined by the axes of rotation of said discs so as to have twist imparted thereto by frictional contact between the yarn and the respective opposed friction surfaces resulting from the force exerted by said pressure applying member, and then pivoting said discs and pressure applying member through 180 degrees about an axis which substantially lies in the plane defined by the axes of rotation of said discs and extends parallel to and between the friction surfaces of said discs, changing the axial position of the discs with respect to the yarn path in such a way that the one disc having been positioned in front of the plane defined by the friction surfaces is positioned behind said plane and the other disc having been positioned behind said plane is now positioned in front of said plane to thereby convert from S to Z twist or vice versa, by changing the direction of rotation of the discs without changing the yarn path of travel.

* * * * *